United States Patent [19]

Hedgewick

[11] Patent Number: 4,883,384

[45] Date of Patent: Nov. 28, 1989

[54] PROTECTIVE ROADWAY MARKER GUARD RAILS

[75] Inventor: Peter Hedgewick, Windsor, Canada

[73] Assignee: Pac-Tec, Inc., Newark, Ohio

[21] Appl. No.: 284,127

[22] Filed: Dec. 14, 1988

[51] Int. Cl.[4] ..... G08B 1/00

[52] U.S. Cl. ..... 404/14; 404/16

[58] Field of Search ..... 404/12, 14, 15, 16

[56] References Cited

U.S. PATENT DOCUMENTS

| | | | |
|---|---|---|---|
| 3,485,148 | 12/1969 | Heenan | 404/12 |
| 4,208,090 | 6/1980 | Heenan | 404/14 |
| 4,428,320 | 1/1984 | Optl et al. | 404/14 |
| 4,557,624 | 12/1985 | Walker | 404/14 |
| 4,624,601 | 11/1986 | Quittner | 404/12 |

FOREIGN PATENT DOCUMENTS

| | | | |
|---|---|---|---|
| 1036825 | 8/1983 | U.S.S.R. | 404/14 |
| 759309 | 10/1956 | United Kingdom | 404/12 |

*Primary Examiner*—Stephen J. Novosad
*Assistant Examiner*—Gay Ann Spahn
*Attorney, Agent, or Firm*—Reising, Ethington, Barnard Perry & Milton

[57] ABSTRACT

A roadway pavement marker protective member defined by a single rail for the protection of pavement markers. A pavement marker is placed on the roadway surface and one or two of these rails are placed about the pavement marker for its protection. The protective member deflects potential hazards presented by oncoming traffic, such as snowplow machines, from the pavement marker and prevents it from being dislodged.

12 Claims, 1 Drawing Sheet

FIG. 1
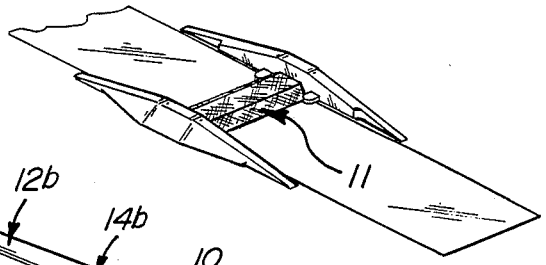
FIG. 3
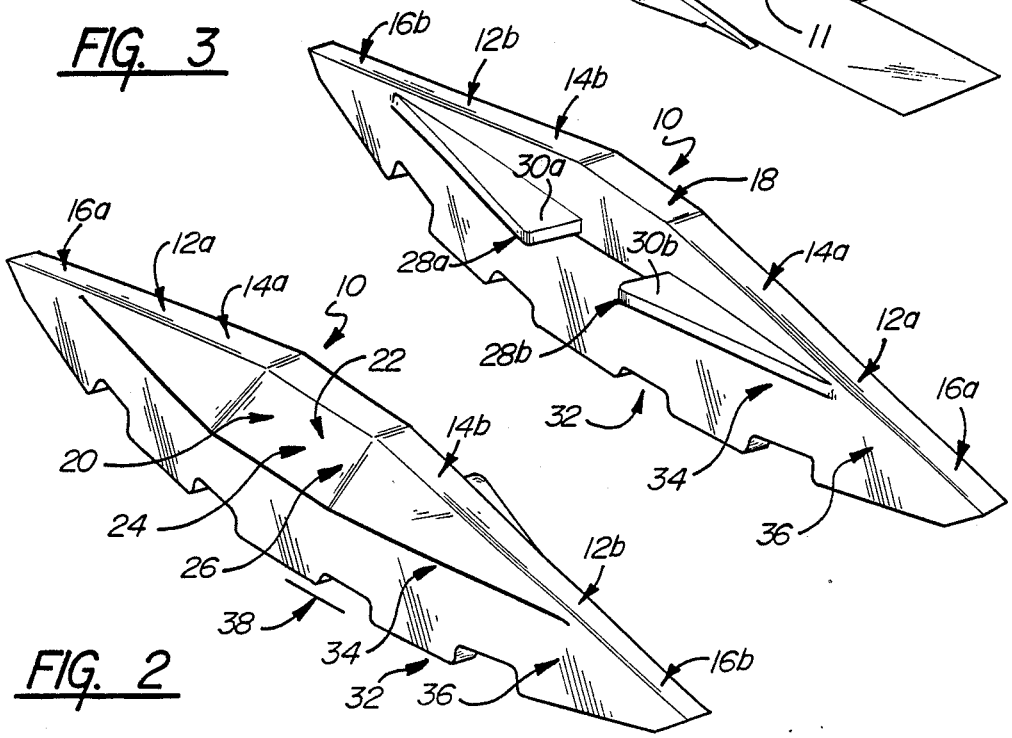
FIG. 2
FIG. 4
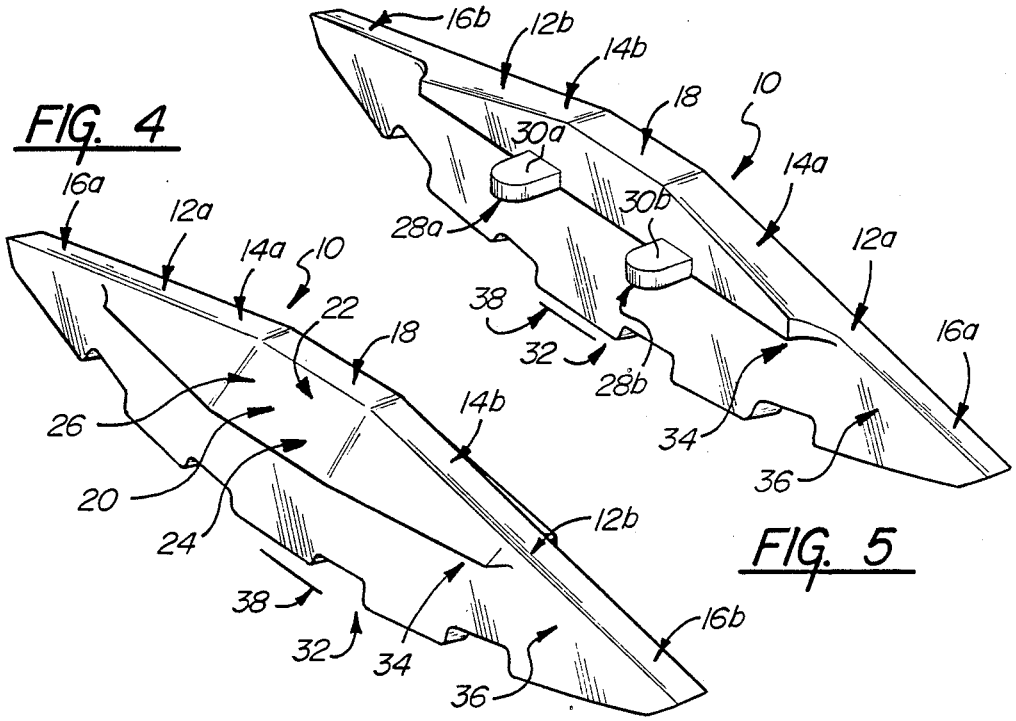
FIG. 5

PROTECTIVE ROADWAY MARKER GUARD RAILS

TECHNICAL FIELD

The technical field of this invention includes protective members for protecting roadway markers from the hazards of roadway usage. This includes those particularly suited for protection against snowplows.

BACKGROUND ART

Roadway markers are used to delineate the roadway to drivers. They are particularly useful during inclement weather or at night. Markers are usually reflectors that reflect light back to oncoming vehicles. They may also be an independent, self-illuminating light source.

These markers are susceptible to damage. One of the main causes of damage has been snowplow blades. In the past protective castings have been developed to protect the marker. See U.S. Pat. Nos. 4,195,945 and 4,155,666. Currently, protective castings require a cut in the pavement to recess them, thereby minimizing their height above the roadway. Because of their bulk a considerable hole is required. This causes a weakening of the roadway surface that eventually causes the castings to be pushed down and rendered ineffective.

Other models sit on top of the road. These castings are higher than the recessed castings and consequently play havoc with snowplow machines.

SUMMARY OF THE INVENTION AND ADVANTAGES

There is provided a guard rail member for protecting roadway markers such as reflectors or lamps from road hazards such as snowplow machines. The guard rails are usually used in pairs but can be used individually. The protective member comprises a guard rail having protective ramps aligned in a common plane. Each ramp has an inclined surface that extends between an upper end and a lower end. The upper ends of the ramps are joined together by a bridging surface. The lower ends are located on opposite ends of the guard rail and are recessed below a roadway surface.

The member further includes a locating means having an upper end and a lower end. The upper end is coincident with the bridging surface and both inclined surfaces. The lower end is at the roadway surface. An inclined ramp connects the upper end and lower end. Longitudinally, the locating means extends between a point on one ramp to a corresponding point on the other ramp.

The protective member is further characterized by a keel member having an upper end and a lower end. The upper end extends from the guard rail to the lower end, which lies below the roadway surface. The keel member has a downwardly curving bottom surface. The keel's bottom surface may be secured, below the roadway surface by the use of an adhesive. The bottom surface may have a notched or battlement configuration which provides more surface area to which the adhesive can adhere further stabilizing the keel.

Casting two keels and a base plate at the same time requires a certain thickness of the base. This added thickness requires a greater recess in the roadway, thereby weakening the roadway. The instant design eliminates the need for a roadway recess to accommodate the base.

One advantage of this design is that only one or two slots need be made for installation in the roadway surface, minimizing damage to the road's structure. Another is that it can be used with markers previously placed on the roadway.

FIGURES IN THE DRAWINGS

Other advantages of the present invention will be readilly appreciated as the same becomes better understood by reference to the following detailed description when considered in connection with the accompanying drawings wherein:

FIG. 1 is a perspective view of one embodiment of the instant invention shown lodged in a roadway surface with the marker it protects;

FIGS. 2 and 3 are perspective views of the instant invention with elongated projection means; and FIGS. 4 and 5 perspective views of the instant invention with narrow projection members.

DETAILED DESCRIPTION OF THE DRAWINGS

A preferred embodiment of a roadway pavement marker protective member or assembly is shown generally in FIGS. 1–5. In the several embodiments shown, like numbers designate like or corresponding sections or parts.

The assembly includes guard rails. The guard rails deflect oncoming objects from hitting the roadway marker 11 it is designed to protect. This is accomplished by the guard rail having two inclined ramps 12*a*, 12*b* aligned in a common plane. Each inclined ramp 12*a*, 12*b* goes from a lower end 16*a*, 16*b* to an upper end 14*a*, 14*b*. When this ramp 12*a*, 12*b* is struck by an obstruction, a snowplow blade for example, the blade rides up along this incline of the ramp 12*a*, 12*b* shielding the roadway marker. The ramps 12*a*, 12*b* are joined at their upper ends 14*a*, 14*b* by a bridging surface 18. This surface 18 helps carry the blade over the reflective marker 11. The lower ends 16*a*, 16*b* of the ramps 12*a*, 12*b* are at diametrically opposed ends of the guard rail. The lower ends are 16*a*, 16*b* are placed beneath a roadway surface to prevent them from catching obstructions posed by oncoming traffic.

Placement of the assembly with respect to the roadway surface is important. To this end a locating means 20 for locating the assembly with respect to a roadway surface is provided. The locating means 20 or locator, has an upper locating end 22 and a lower locating end 24. The upper end 22 is substantially coincident with the guard rail ramps 12*a*, 12*b* and bridging surface 18. The lower locating end 24 is flat on its bottom and designed to rest on the roadway surface. It is positioned between the guard rail and its associated keel member 32. An inclined ramp surface 26 connects the upper 22 and lower 24 ends of the locator 20 providing additional deflection protection to the assembly. Longitudinally, the location extends between a mid-point of each ramp.

On the side of the guard rail that is opposite the locator 20 is a positioning means 28, or positioner for positioning the assembly relative to both the pavement marker and the roadway surface. The positioning means 28 positions the assembly and marker with respect to each other so as to position the marker for maximum protection by the assembly. The positioner has first and second spaced apart projections 30*a*, 30*b*, respectively. The marker is set between the projections 30*a*, 30*b*. The projections 30*a*, 30*b* may have a variety of shapes i.e., narrow, illustrated in FIG. 5, or elongated and tapered, as illustrated in FIG. 3. The bottom side of the projections should be coincident with the roadway surface, in this way the projections serve to locate the assembly with respect to the marker and the roadway.

The assembly is secured in the roadway by a keel member 32. The keel has an upper end 34 and lower end 36. The keel 32 is placed in a slot in the roadway surface and usually secured by an epoxy. A keel 32 having a battlement shape on its downwardly curving bottom surface 38 (as illustrated) would provide greater surface area to which the adhesive, or epoxy, can adhere, providing added stability. Other shapes are possible. A hole may be made in the bottom surface of the keel. The hole could be used to administer adhesive or epoxy to secure the guard rail in the roadway surface. The keel should have a downwardly curved bottom surface 38 to fit in a complimentary recess in the roadway. The upper end 34 of the keel 32 abuts the guard rail and the lower end 36 in the battlement.

The above described protective members may come in a kit. The kit would contain two protective members for placement in the roadway.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A roadway pavement marker (11) protective member comprising; a guard rail (10) having two inclined ramps (12*a*, 12*b*) aligned in a common plane, each inclined ramp (12*a*, 12*b*) going from a lower end (16*a*, 16*b*) to an upper end (14*a*, 14*b*), a bridging surface (18) joins said upper ends (14*a*, 14*b*), said lower ends (16*a*, 16*b*) are at diametrically opposed ends of the guard rail (10), a locating means (20) for locating said member with respect to a roadway surface having an upper locating end (22) and a lower locating end (24), said upper locating end (22) being substantially coincident with said guard rail (10) said lower locating end (24) being located between said guard rail (10) and a keel member (32), with an inclined ramp (26) extending between the upper (22) and lower locating ends (24), positioning means (28) for positioning said protective member relative to both the pavement marker (11) and roadway surface characterized by first and second spaced apart projections (30*a*, 30*b*), one projection (30*a*, 30*b*) being adjacent to each inclined ramp (12*a*, 12*b*) and opposite said locating means (20), a keel member (32) having an upper end (34) and a lower end (36), said upper end (34) extending from the guard rail (10) to the lower end (36), said keel member (32) having a downwardly curved bottom surface (38), said protective member characterized by said guard rails (10) being secured in the roadway surface by said keel member (32) using only one slot in said roadway surface for placement of the protective member with the marker resting on the roadway surface and having an inclined surface to deflect oncoming objects from striking the pavement marker.

2. A roadway pavement marker (11) protective member as claimed in claim 1 further comprising positioning means consisting of two parallel projections for surrounding a roadway marker, each positioned perpendicular to the plane of the guard rail.

3. A roadway pavement marker (11) protective member as claimed in claim 1 further comprising positioning means consisting of two parallel projections that taper from a first position toward a second position.

4. A roadway pavement marker (11) protective member as claimed in claim 1 further comprising a keel member (32) having a battlement shape on its downwardly curving bottom surface (38).

5. A roadway pavement marker (11) protective member kit comprising; two unconnected guard rails (10), each guard rail (10) having two inclined ramps (12*a*, 12*b*) aligned in a common plane, each inclined ramp (12*a*, 12*b*) going from a lower end (16*a*, 16*b*) to an upper end (14*a*, 14*b*), a bridging (18) surface joins said upper ends (14*a*, 14*b*) said lower ends (16*a*, 16*b*) are at diametrically opposed ends of the guard rail (10), a locating means (20) for locating said protective member with respect to a roadway surface, associated with each guard rail (10) having an upper locating end (22) and a lower locating (24) end, said upper locating end (22) being substantially coincident with said guard rail (10) said lower end (24) being between said guard rail (10) and a keel member (32) with an inclined ramp (26) extending between the upper (22) and lower (24) locating ends, positioning means (28) for positioning said protective member relative to both the pavement marker and roadway, characterized by first (30*a*) and second (30*b*) spaced apart projections, one projection (30*a*, 30*b*) adjacent to each inclined ramp (12*a*, 12*b*) and opposite said locating means (20), a keel member (32) having an upper end (34) and a lower end (36), said upper end (34) extending from the guard rail (10) and the lower end (36) said lower end (36) being below the roadway surface, said keel member (32) having a downwardly curved bottom surface (38), said protective member kit characterized by said two unconnected guard rails being secured in the roadway surface by their respective keels into two slots in the pavement with the marker resting on the roadway surface, each having an inclined surface to deflect oncoming objects from striking said pavement marker.

6. A roadway pavement marker (11) protective member as claimed in claim 5 further comprising positioning means consisting of two parallel projections for surrounding a roadway marker, each positioned perpendicular to the plane of the guard rail.

7. A roadway pavement marker (11) protective member as claimed in claim 5 further comprising positioning means consisting of two parallel projections that taper from a first position toward a second position.

8. A roadway pavement marker (11) protective member as claimed in claim 5 further comprising a keel member (32) having a battlement shape on its downwardly curving bottom surface (38).

9. A roadway pavement marker (11) protective member in a roadway pavement surface comprising; a guard rail (10) having two inclined ramps (12*a*, 12*b*) aligned in a common plane, each inclined ramp (12*a*, 12*b*) going from a lower end (16*a*, 16*b*) to an upper end (14*a*, 14*b*), a bridging surface (18) joins said upper ends (14*a*, 14*b*), said lower ends (16*a*, 16*b*) are at diametrically opposed ends of the guard rail (10), a locating means (20) for locating said member with respect to a roadway surface having an upper locating end (22) and a lower locating end (24) said upper locating end (22) being substantially coincident with said guard rail (10) and said lower locating end (24) being located at the roadway surface, between said guard rail (10) and a keel member (32), with an inclined ramp (26) extending between the upper (22) and lower locating end (24), positioning means (28) for positioning said protective member relative to both the pavement marker (11) and roadway surface characterized by first and second spaced apart projections (30*a*, 30*b*), one projection (30*a*, 30*b*) being adjacent to each inclined ramp (12*a*, 12*b*) and opposite said locating means (20) and resting on the roadway surface, a keel member (32) having an upper end (34) and a lower end (36), said lower end being recessed below the roadway surface, said upper end extending from the guard rail (10) to the lower end (36), said keel member (32) having a downwardly curved bottom surface (38) beneath the roadway surface, said protective member characterized by said guard rails (10) being secured in the roadway surface by said keel members (32) using only one slot in said roadway surface for placement of the protective member with the marker resting on the roadway surface and having an inclined surface to reflect oncoming objects from striking the pavement marker.

10. A roadway pavement marker (11) protective member as claimed in claim 9 further comprising positioning means consisting of two parallel projections for surrounding a roadway marker, each positioned perpendicular to the plane of the guard rail.

11. A roadway pavement marker (11) protective member as claimed in claim 9 further comprising positioning means consisting of two parallel projections that taper from a first position toward a second position.

12. A roadway pavement marker (11) protective member as claimed in claim 9 further comprising a keel member (32) having a battlement shape on its downwardly curving bottom surface (38).

* * * * *